US008398331B2

(12) United States Patent
Esdaile

(10) Patent No.: US 8,398,331 B2
(45) Date of Patent: Mar. 19, 2013

(54) ADJUSTABLE PIPE COUPLING ASSEMBLY

(75) Inventor: Douglass Alan Esdaile, Chipping Norton (AU)

(73) Assignees: Douglas Alan Esdaile, Chipping Norton NSW (AU); Mary Imelda Esdaile, Chipping Norton NSW (AU)

( * ) Notice: Subject to any disclaimer, the term of this patent is extended or adjusted under 35 U.S.C. 154(b) by 42 days.

(21) Appl. No.: 12/678,743

(22) PCT Filed: Sep. 19, 2008

(86) PCT No.: PCT/AU2008/001402

§ 371 (c)(1), (2), (4) Date: Mar. 17, 2010

(87) PCT Pub. No.: WO2009/036518

PCT Pub. Date: Mar. 26, 2009

(65) Prior Publication Data

US 2010/0213708 A1 Aug. 26, 2010

(30) Foreign Application Priority Data

Sep. 19, 2007 (AU) ..... 2007905106

(51) Int. Cl.
*E04G 7/08* (2006.01)

(52) U.S. Cl. ..... 403/385; 403/49; 403/53

(58) Field of Classification Search ..... 403/49, 403/53, 62, 64, 150, 157, 385, 388–391, 403/399, 400, 161, 188, 196, 234, 180, 237, 403/241, 186, 78

See application file for complete search history.

(56) References Cited

U.S. PATENT DOCUMENTS

| | | | | | |
|---|---|---|---|---|---|
| 1,706,801 | A * | 3/1929 | Merrill | 403/385 |
| 1,835,473 | A * | 12/1931 | Davidson | 403/53 |
| 2,101,317 | A * | 12/1937 | Lemieux | 403/53 |
| 2,392,932 | A * | 1/1946 | MacBeth | 403/73 |
| 2,876,027 | A * | 3/1959 | Sulmonetti | 403/53 |
| 3,041,092 | A * | 6/1962 | Eves et al. | 403/73 |
| 3,103,352 | A * | 9/1963 | Steffen | 269/45 |
| 3,495,857 | A * | 2/1970 | Hawke et al. | 403/57 |
| 3,677,582 | A * | 7/1972 | Flick | 403/391 |
| 3,684,058 | A * | 8/1972 | Brown | 182/132 |
| 4,561,797 | A * | 12/1985 | Aldridge | 403/58 |
| 4,841,708 | A * | 6/1989 | Johnston | 52/646 |
| 5,143,413 | A * | 9/1992 | Vandenhoek | 292/302 |
| 5,427,465 | A * | 6/1995 | Sato | 403/49 |
| 7,198,284 | B2 * | 4/2007 | Cerreto et al. | 280/650 |
| 7,228,937 | B2 * | 6/2007 | Morris | 182/82 |
| 7,971,840 | B2 * | 7/2011 | Hirschhorn | 248/281.11 |
| 2003/0235320 | A1 * | 12/2003 | Hirschhorn | 381/333 |

* cited by examiner

*Primary Examiner* — Joshua Kennedy
(74) *Attorney, Agent, or Firm* — Michael Molins

(57) ABSTRACT

An adjustable pipe coupling assembly (10) has first and second clamps (30, 32), rotating elements (38, 40, 44) for the clamps, first and second pipes (16, 18), and first and second pivot elements (60). The clamp (30) includes opposed ears (52, 54) which locate the pipe (16) therebetween. The pipe (16) can pivot about an axis. The clamp (32) includes opposed ears (52, 54) which locate the pipe (18) therebetween. The pipe (18) can pivot about an axis. In use, rotating the clamps adjusts the horizontal angle between the axes, and pivoting the pipes about their respective pivot means adjusts the vertical angle between the pipes.

6 Claims, 9 Drawing Sheets

34
74
76
34

78
34
80

ADJUSTABLE PIPE COUPLING ASSEMBLY

FIELD OF THE INVENTION

The present invention relates to an adjustable pipe coupling assembly and, in particular, to an assembly for coupling or cross connecting pipes at desired angles in a roof support arrangement for a shade structure.

Although the background, objects and preferred embodiments of the invention will be hereinafter described with reference to an assembly and process for cross connecting pipes during the construction of shade structures, it is to be understood that the invention is not limited thereto but has wider application. For example, the adjustable pipe coupling assembly may be used for constructing scaffolding used in building construction, or for constructing equipment in which pipes that are to be cross connected need to be directed at specific angles to each other.

It is to be understood that the terminology employed herein is for the purpose of description only and should not be regarded as limiting. For instance, the terms "comprising" or "comprises" are to be understood as meaning "including", unless otherwise stated. Also, the term "pipe" is to be understood as including small or large diameter pipes and pipes of any suitable cross sectional shape.

BACKGROUND OF THE INVENTION

There are many kinds of shade structures and they are put to many types of use. Commonly, they are used to create shade from the sun at the rear of homes, but may also be used in commercial and industrial settings.

A typical shade structure comprises posts that hold aloft a water proof fabric sheet by cross connected roof pipes, the angle of cross connection being determined prior to "on site" welding of the roof support arrangement. The pipes used in such roof support arrangements have flanges welded thereto that cross connect the pipes when a bolt is passed through a common hole formed when the two flanges overlap. The setting of the bolt in this predetermined position prohibits slight adjustment of the relative positions or angle of cross connection of the pipes that may be necessary to counter any unforeseen inaccuracies during "on site" construction, such as those that may arise from variation in the post height or the level of the ground.

These inaccuracies are particularly pronounced in the "on site" construction of shade structures in which the cross connected pipes define an arched roof support arrangement, where pipes serving as linear bearers and extending in a first direction are connected with pipes serving as curved rafters and extending in a cross direction. For each curved rafter, a slightly different angle of connection is required at different locations along its length where it is cross connected with a respective bearer so as to attain an optimum contour of roof support arrangement for tightly fitting a water proof fabric sheet thereto.

It has been found by the present inventor that none of the prior art methods of cross connecting pipes in a roof support arrangement of a shade structure allow for slight adjustment of the angle of cross connection of the pipes during "on site" construction that would counter any unforeseen inaccuracies in the pipe angles and attain the optimum contour mentioned above.

SUMMARY OF THE INVENTION

It is, therefore, an object of the present invention to overcome or substantially ameliorate the disadvantages and problems of the aforementioned prior art, or at least provide a useful alternative.

It is another object of the present invention to provide an adjustable pipe coupling assembly that can be used to cross connect pipes during the "on site" construction of a shade structure without the requirement for welding, and that preferably will enable no more than two people to carry out the construction.

It has been found by the present inventor that these and other objects of the invention may be achieved in general by providing an adjustable pipe coupling assembly comprising:

(a) a first clamp, (b) a second clamp, and (c) means for rotating the clamps independently about a first common axis shared by the clamps and extending vertically, (d) the first clamp including a first pair of opposed ears spaced apart so as to allow a first pipe to be located therebetween, each one of the opposed ears having a hole formed therethrough, the pair of holes sharing a second common axis extending in a first horizontal plane and being adapted to receive first pivot means therethrough for engaging the first pipe, the first pipe being pivotable in a first vertical plane about the second common axis, (e) the second clamp including a second pair of opposed ears spaced apart so as to allow a second pipe to be located therebetween, each one of the opposed ears having a hole formed therethrough, the pair of holes sharing a third common axis perpendicular to the second common axis and extending in a second horizontal plane, the pair of holes being adapted to receive second pivot means therethrough for engaging the second pipe, the second pipe being pivotable in a second vertical plane about the third common axis, the arrangement being such that, in use, the rotating means rotate the clamps so as to adjust the horizontal angle between the second and third common axes, and each of the first and second pivot means pivot their respective pipe so as to adjust the vertical angle between the first and second pipes.

Preferably, the first and second clamps include respective planar surfaces that face each other, each planar surface having a hole formed therethrough, the holes being aligned to define the first common axis, and a pin passing through the holes to allow the clamps to rotate independently about the first common axis.

In a preferred form, the pin is a bolt.

It is preferred that the first clamp includes a cradle for tightly receiving a head of the bolt.

There has been thus outlined, rather broadly, the more important features of the invention in order that the detailed description thereof that follows may be better understood and put into practical effect, and in order that the present contribution to the art may be better appreciated.

There are additional features of the invention that will be described hereinafter. As such, those skilled in the art will appreciate that the conception, upon which the disclosure is based, may be readily utilized as the basis for designing other assemblies and processes for carrying out the objects of the present invention. It is important, therefore, that the broad outline of the invention described above be regarded as including such equivalent constructions in so far as they do not depart from the spirit and scope of the present invention.

SUMMARY OF THE DRAWINGS

The invention will be better understood and objects other than those set forth above will become apparent when consideration is given to the following detailed description thereof. Such description makes reference to the accompanying drawings, in which.

DESCRIPTION OF PREFERRED EMBODIMENTS

Figure 1:
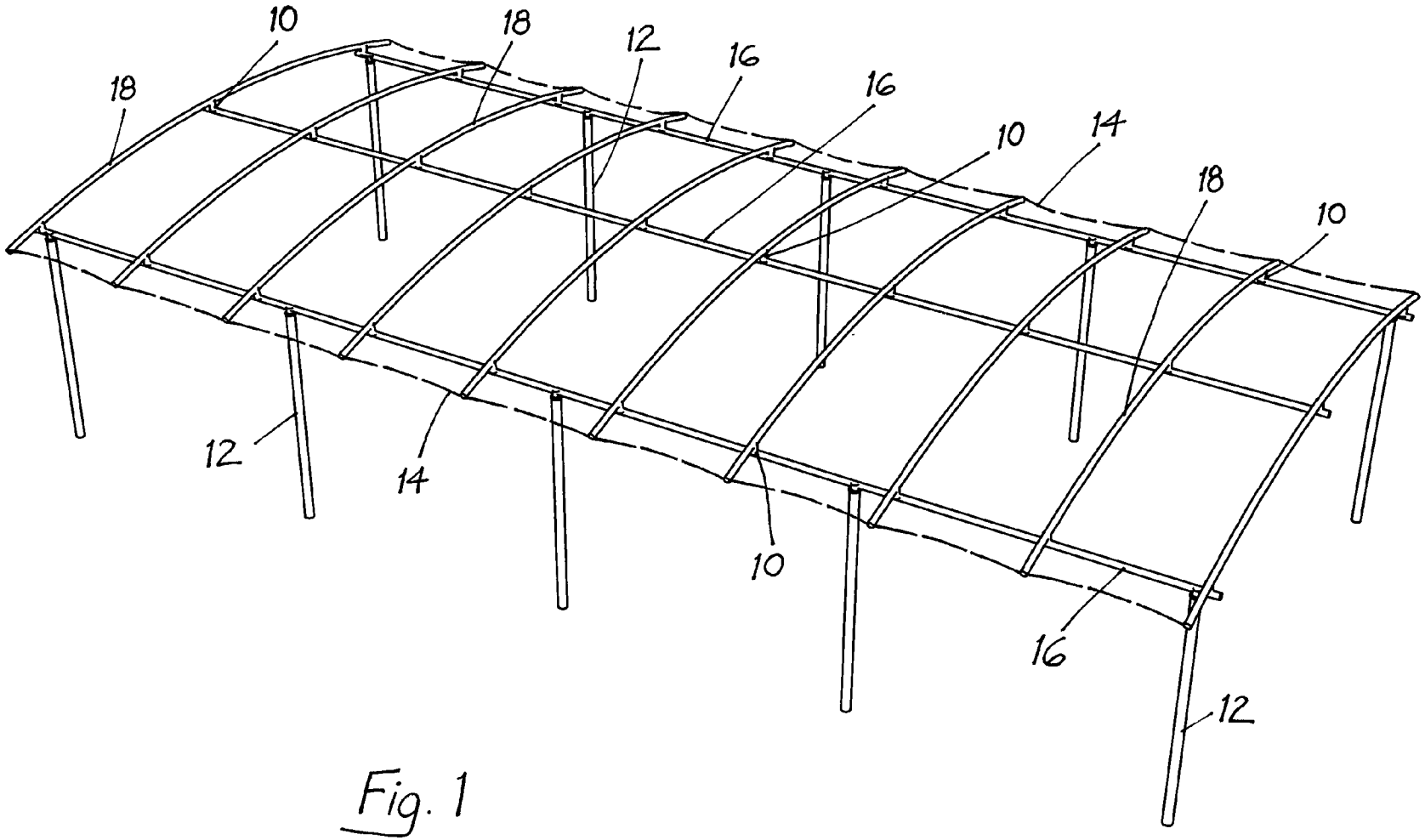
FIG. 1 is a side perspective view of a shade structure that includes an adjustable pipe coupling assembly according to a preferred embodiment of the invention.

With reference now to the above summarized drawings of FIGS. 1 to 9, an adjustable pipe coupling assembly embodying the principles and concepts of the present invention and generally designated by the reference numeral 10 will now be described.

The shade structure shown in FIG. 1 has posts 12 that hold aloft a shade providing sheet 14 (shown in phantom with dashed outline), such as may be made of a water proof fabric, by cross connected roof pipes 16, 18 that define an arched roof support arrangement. The pipes 16 are in the form of linear bearers and extend in a first direction. The pipes 18 are in the form of curved rafters and extend in a second direction perpendicular to the first direction.

Figure 2:
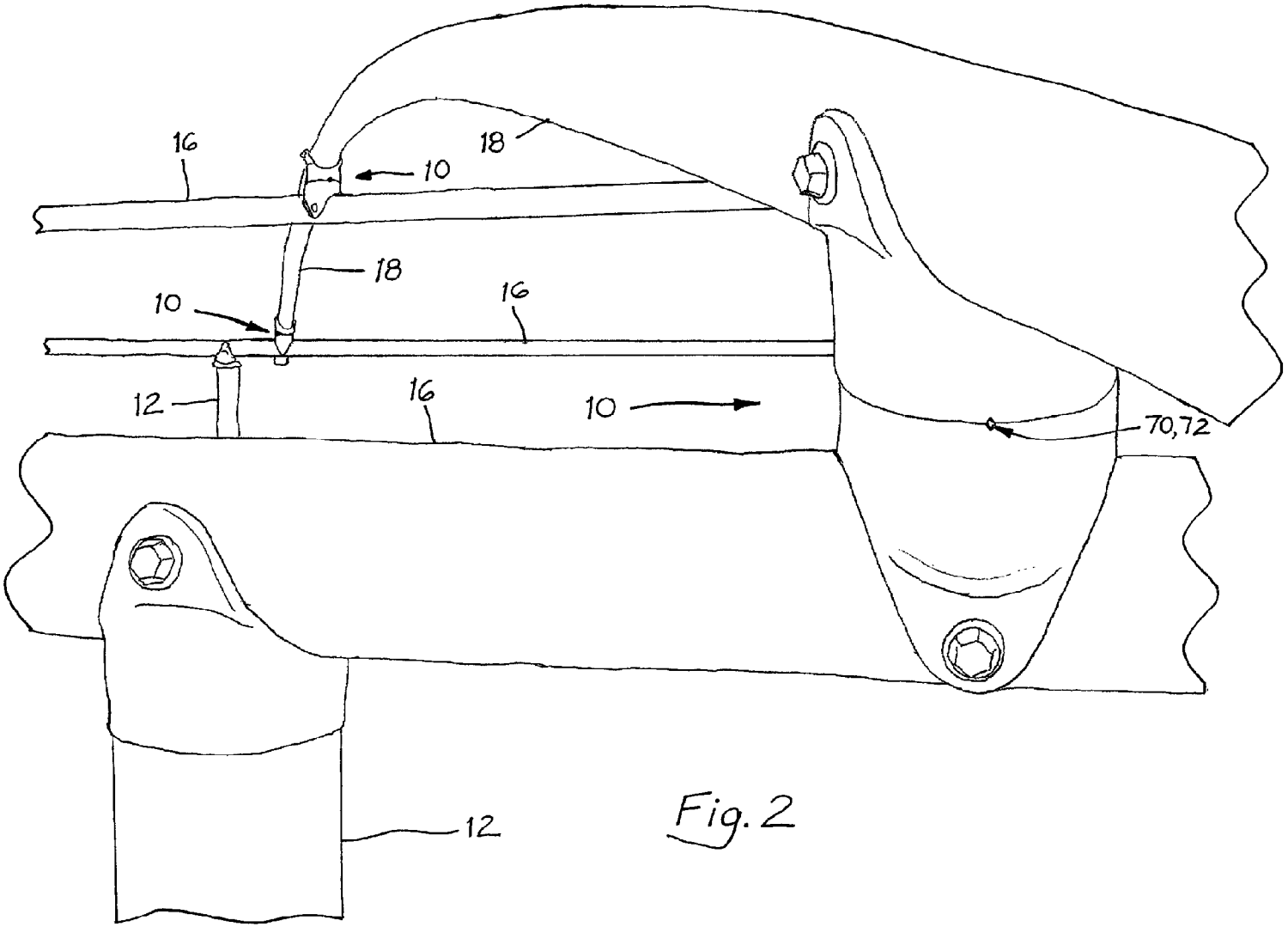
FIG. 2 is a side perspective view (from a first angle) of a portion of the roof support arrangement of the shade structure of FIG. 1.
Figure 3:
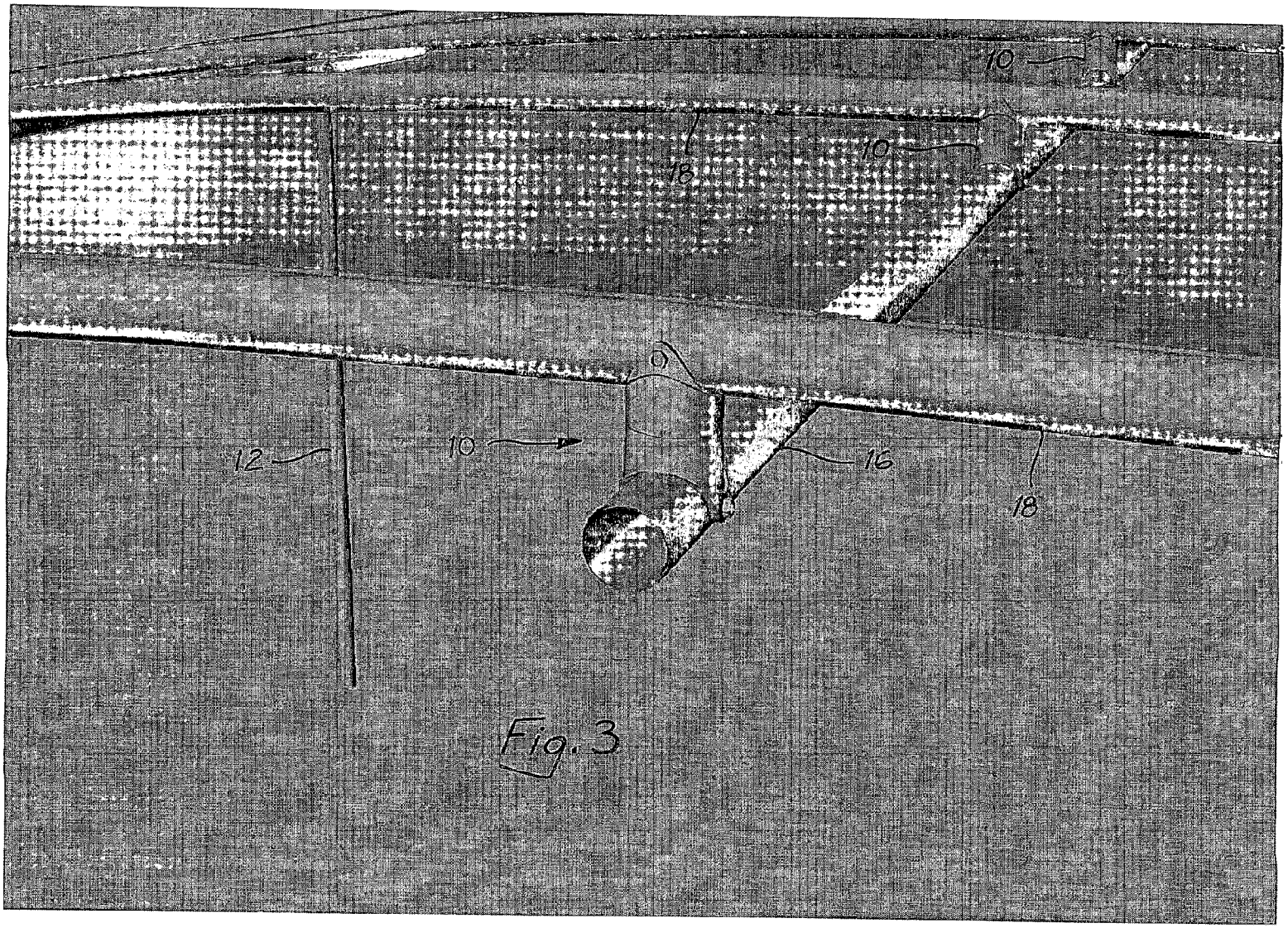
FIG. 3 is a side perspective view (from a second angle) of a portion of the roof support arrangement of the shade structure of FIG. 1.

Adjustable pipe coupling assemblies 10 cross connect the roof pipes 16, 18 of the shade structure at desired angles. As shown in FIG. 2, for each adjustable pipe coupling assembly 10 connected at different locations along the length of a curved rafter or pipe 18, a slightly different angle of connection with the pipe 18 is required to account for the curvature and for any inaccuracies in the construction. As shown in FIG. 3, for each adjustable pipe coupling assembly 10 connected at different locations along the length of the linear bearer or pipe 16, the same angle of connection with the pipe 16 is required.

Figure 4:
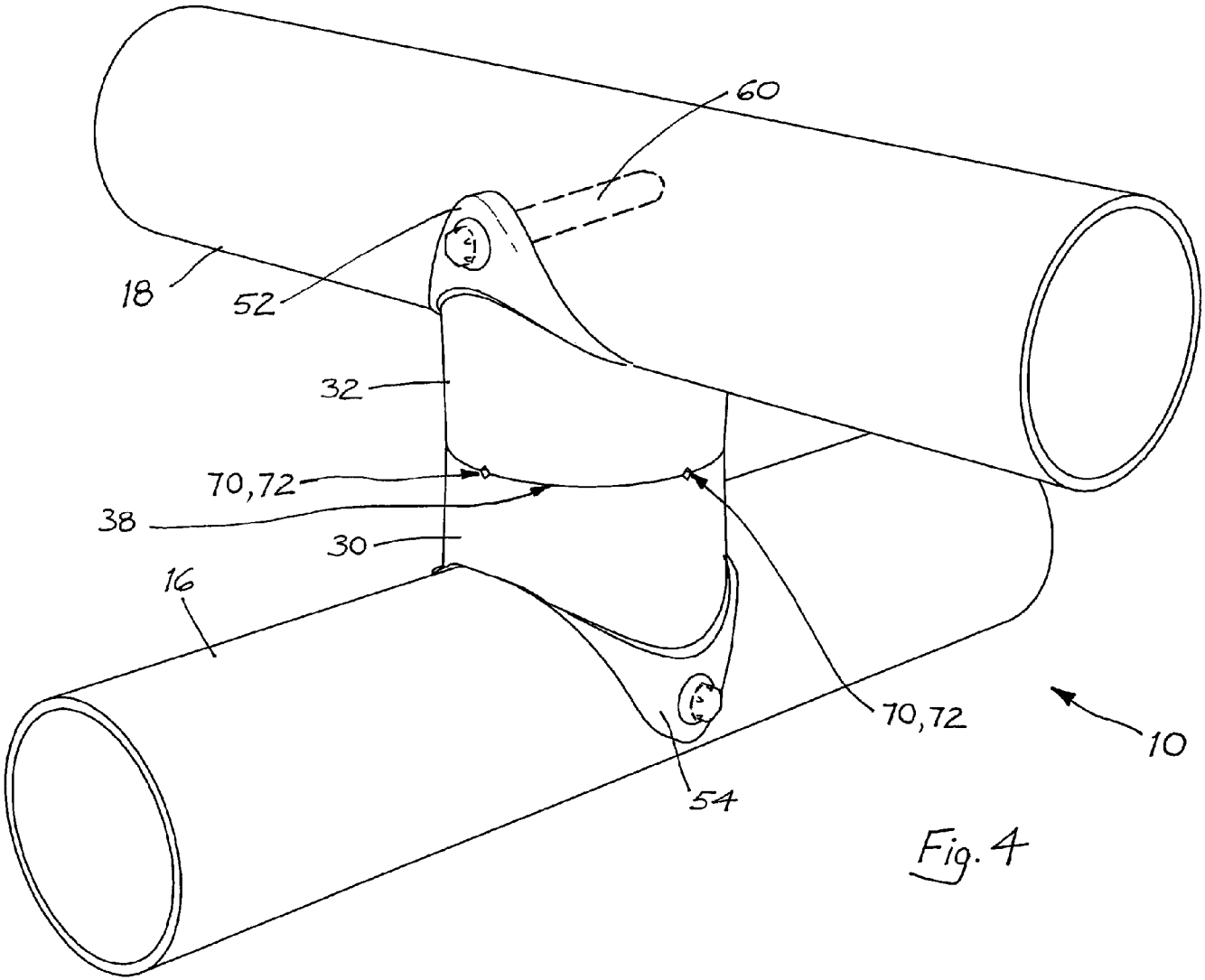
FIG. 4 is a perspective view of the adjustable pipe coupling assembly used in the shade structure of FIG. 1, shown cross connecting first and second pipes.

The adjustable pipe coupling assembly 10 shown in FIG. 4 cross connecting the roof pipes 16, 18 comprises a first clamp 30, a second clamp 32, and means for rotating the clamps 30, 32 independently about a first common axis shared by the clamps and extending vertically.

Figure 5:
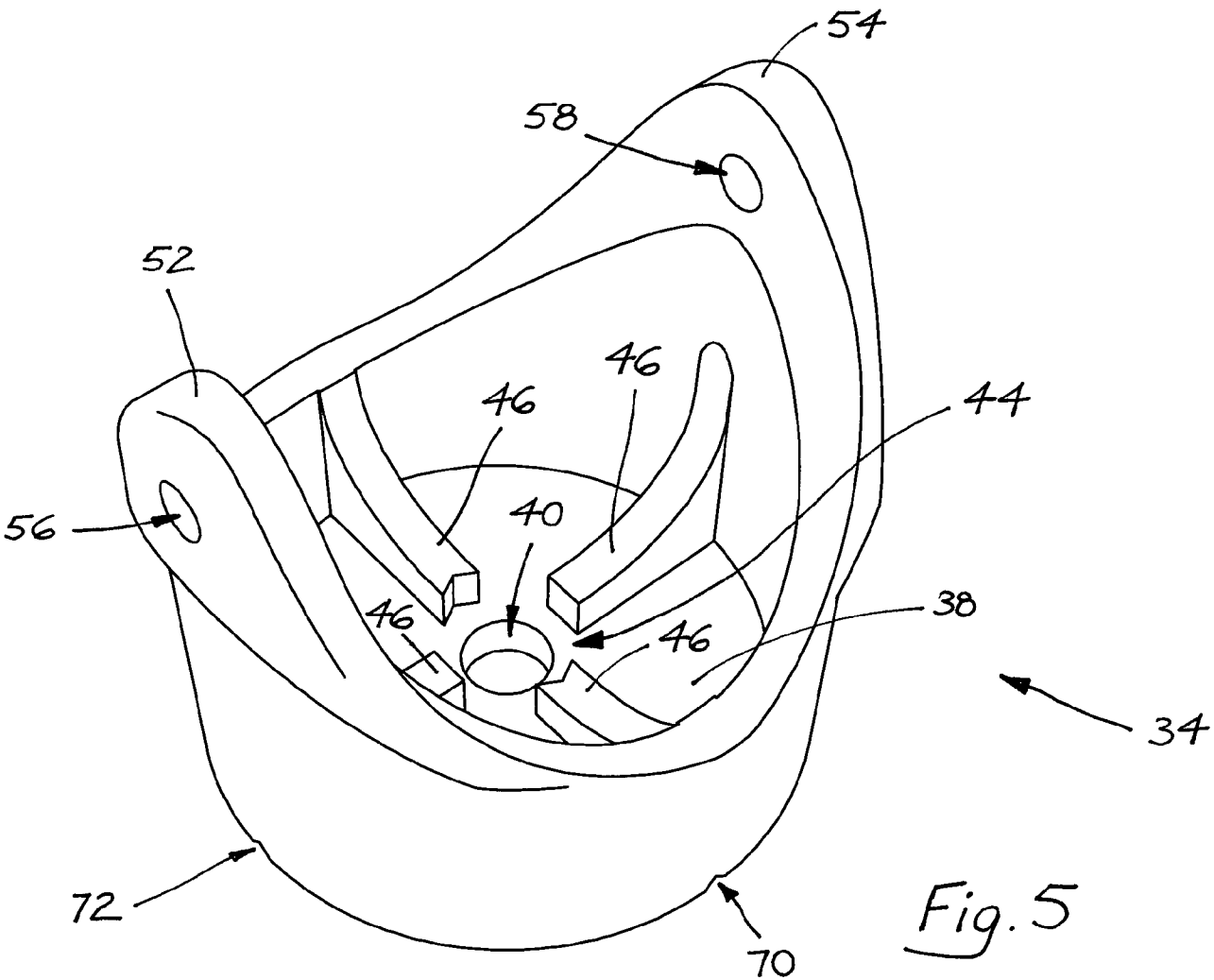
FIG. 5 is a top perspective view of a preferred clamp that may be used in the adjustable pipe coupling assembly shown in FIG. 4.
Figure 6:
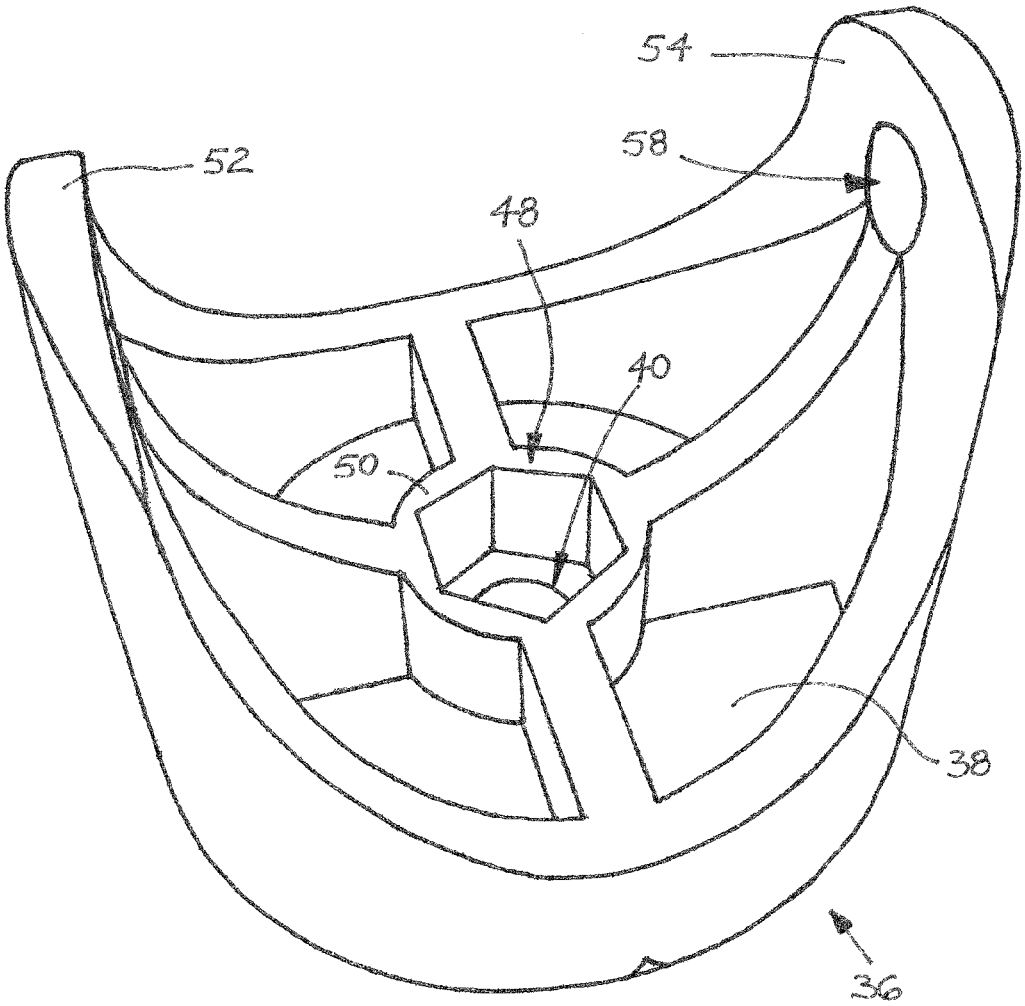
FIG. 6 is a top perspective view of another preferred clamp that may be used in the adjustable pipe coupling assembly shown in FIG. 4.

A preferred rotating means is partly shown in each of the clamps 34, 36 shown in FIGS. 5 and 6. Each clamp 34, 36 (like the clamps used in the adjustable pipe coupling assembly 10) includes a planar surface 38 that, when assembled to form the adjustable pipe coupling assembly, face each other. The planar surface 38 has a hole 40 formed therethrough, with the holes 40 of each clamp 34, 36 being aligned to define the first common axis. A pin (not shown), preferably in the form of a bolt, passes through the aligned holes 40 to allow the clamps 34, 36 to rotate independently about the first common axis. Each of the clamps 34, 36 include a cradle and, when a bolt is used, the head of the bolt is tightly received in the cradle formed within at least one of the clamps. FIG. 5 shows a cradle 44 formed by the suitably shaped end surfaces of four reinforcement ribs 46 inside the clamp 34. FIG. 6 shows a cradle 48 formed by a suitably shaped socket 50 inside the clamp 36. Both cradles 44, 48 are suited to receiving a hexagonal shaped head of a bolt. Furthermore, where the clamps 34, 36 serve as the first and second clamps in an adjustable pipe coupling assembly, one of the cradles may tightly receive the head of the bolt and the other of the cradles may receive a hexagonal shaped nut that threadably engages the shaft of the bolt. Each clamp 34, 36 has four orientation notches (only notches 70, 72 shown) in the form of small cut-outs, equally spaced apart around its circumferential edge that abuts the other clamp 34, 36 of the adjustable pipe coupling assembly 10. These orientation notches 70, 72 are for the purpose of ensuring perpendicular orientation or alignment between the clamps 34, 36, or of adjusting their relative orientation away from being perpendicular to a desired degree.

The first clamp 30 of the adjustable pipe coupling assembly 10 shown in FIG. 4 also comprises a pair of opposed ears 52, 54, also shown in the clamps 34, 36 of FIGS. 5 and 6 respectively. The opposed ears are spaced apart so as to allow the pipe 16 to be located therebetween. Each one of the opposed ears 52, 54 has a hole 56, 58, respectively, formed therethrough. The holes 56, 58 share a second common axis extending in a first horizontal plane and are adapted to receive first pivot means therethrough for engaging the pipe 16. The first pivot means is, in this embodiment, in the form of a bolt 60. As a result, the pipe 16 is pivotable in a first vertical plane about the second common axis.

The second clamp 32 of the adjustable pipe coupling assembly 10 shown in FIG. 4 is structurally identical to the first clamp 30, but its opposed ears 52, 54 allow the pipe 18 to be located therebetween. The holes 56, 58 formed through the opposed ears share a third common axis perpendicular to the second common axis and extending in a second horizontal plane. The holes 56, 58 are adapted to receive second pivot means therethrough, such as bolt 60, for engaging the pipe 18. As a result, the pipe 18 is pivotable in a second vertical plane about the third common axis.

In use of the adjustable pipe coupling assembly 10, the clamps 30, 32 are rotated with reference to their respective orientation notches 70, 72 so as to adjust the horizontal angle between the second and third common axes (and so correspondingly rotating the pipes 16, 18), and each of the pipes 16, 18 are pivoted so as to adjust the vertical angle between them. Such independent angular movement of the pipes 16, 18, as facilitated by the assembly 10, both horizontally and vertically allows for slight adjustment in the angle of cross connection of the pipes during "on site" construction of the shade structure as required to attain the optimum contour of roof support arrangement for tightly fitting a water proof or other fabric sheet thereto.

Figure 7:
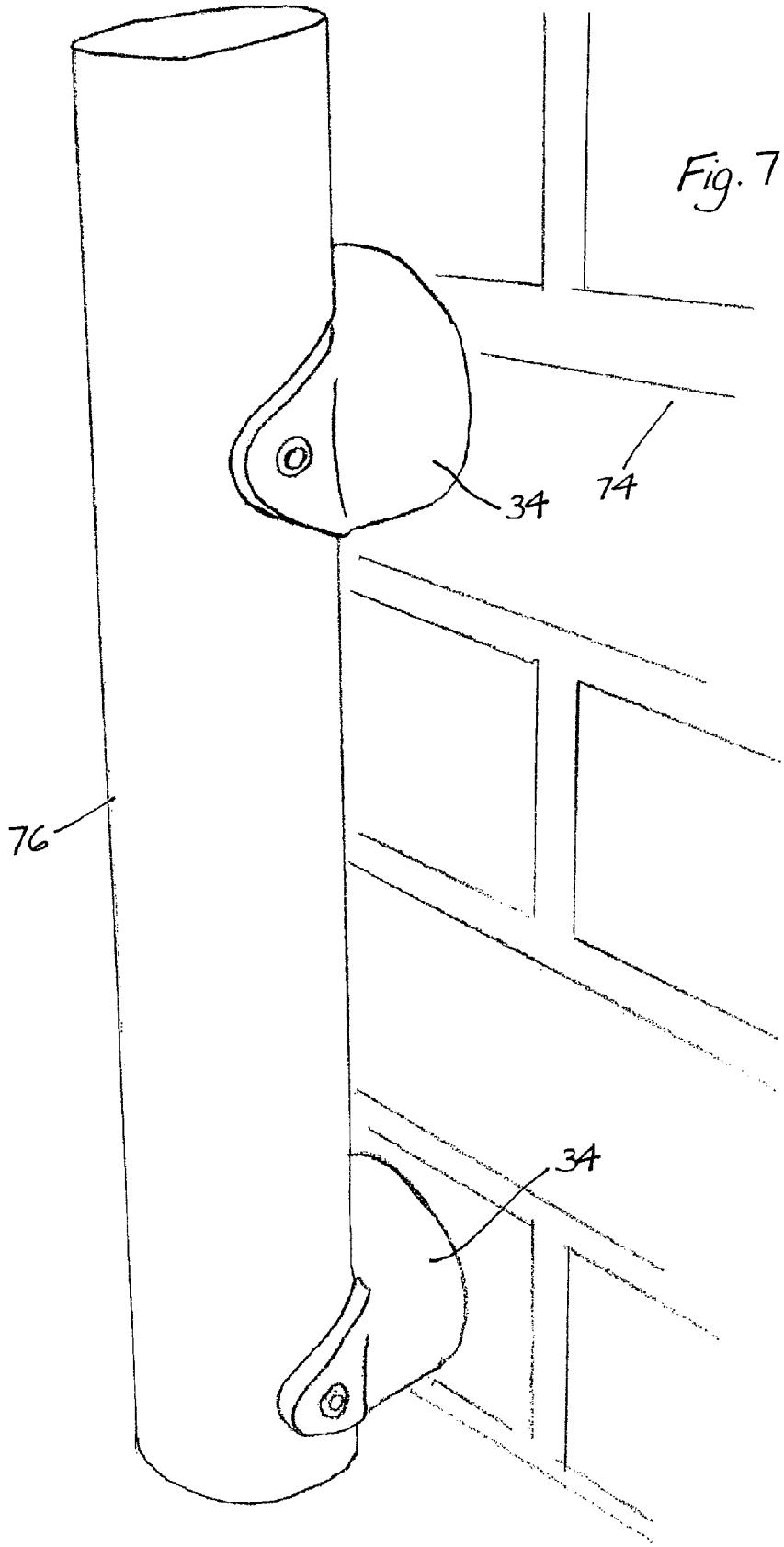
FIG. 7 is a side perspective view of a portion of a wall support arrangement of a framework structure that includes the clamp shown in FIG. 5 for supporting a vertical pipe to a wall.
Figure 8:
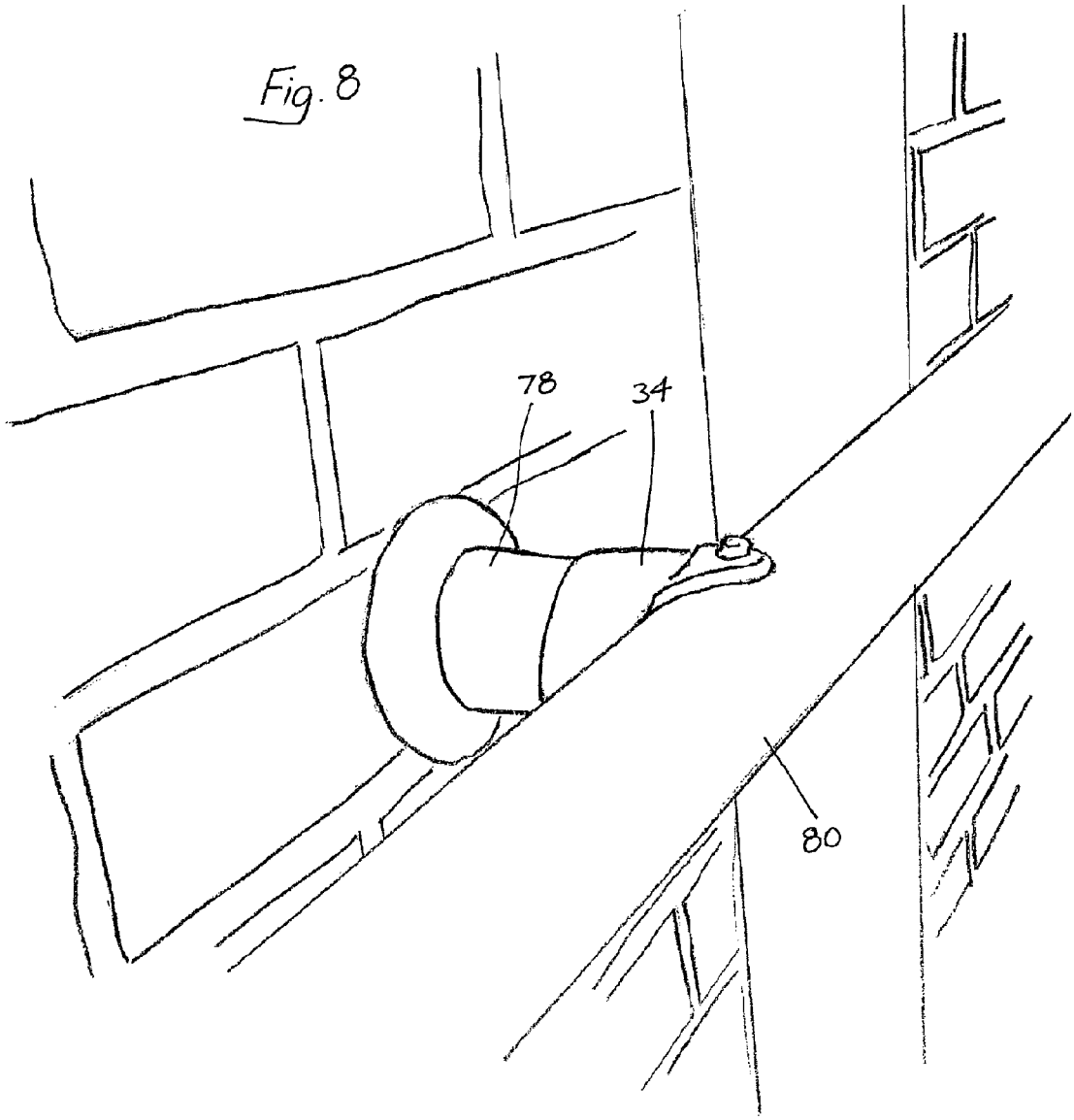
FIG. 8 is a side perspective view of a portion of another wall support arrangement of a framework structure that includes the clamp shown in FIG. 5 connected to a wall mount for supporting a horizontal pipe to a wall.
Figure 9:
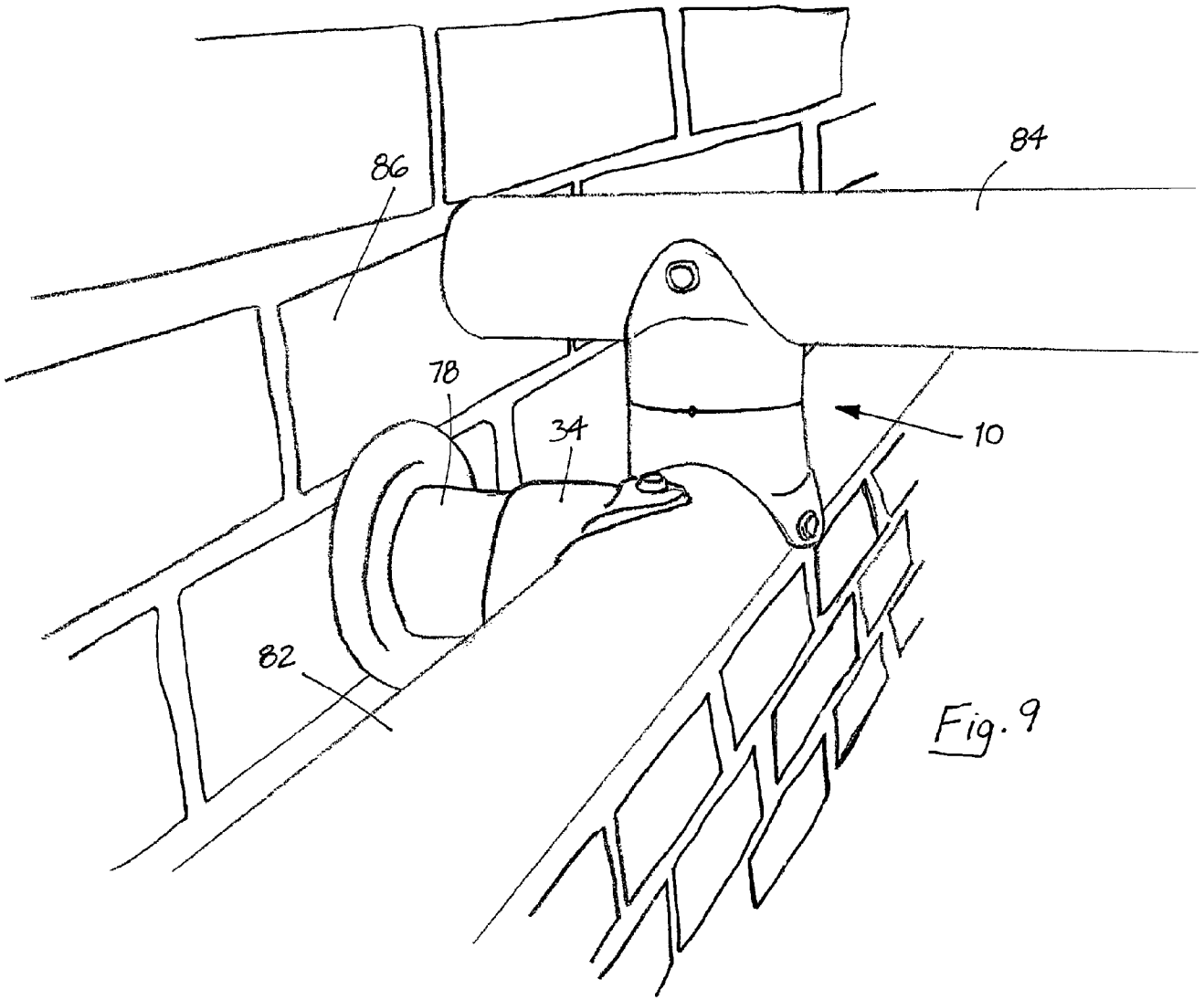
FIG. 9 is a side perspective view of a portion of yet another wall support arrangement of a framework structure that includes the adjustable pipe coupling assembly shown in FIG. 4 for cross connecting first and second pipes, and that includes the clamp shown in FIG. 5 connected to a wall mount for supporting the first pipe to a wall.

FIGS. 7, 8 and 9 each show a portion of various wall support arrangements of a framework structure that (in each of FIGS. 7, 8 and 9) utilize the clamp shown in FIG. 5 and (in FIG. 9) also utilizes the adjustable pipe coupling assembly shown in FIG. 4.

Referring to FIG. 7, a pair of the clamps 34 are bolted to a wall 74 via their respective holes 40 and support a vertical pipe 76 of a framework structure.

Referring to FIG. 8, the clamp 34 is connected to a wall mount 78 and supports a horizontal pipe 80.

Referring to FIG. 9, the adjustable pipe coupling assembly 10 cross connects horizontal first and second pipes 82, 84 in a perpendicular orientation, with the first pipe 82 being supported to a wall 86 by the wall mount 78 and an interconnected clamp 34.

As another example of its versatility in use, the clamp 34 may generally be connected to the top of a post in a desired structure or to the top of a wall if required.

It will be readily apparent from the above that there are various advantages of the present invention.

One advantage is that, by using the adjustable pipe coupling assembly of the present invention to cross connect pipes in a roof support arrangement of a shade structure, slight adjustments of the angles of cross connection of the pipes during "on site" construction can be made so as to counter any unforeseen inaccuracies in the pipe angles and attain the optimum contour mentioned above.

Other advantages are that the adjustable pipe coupling assembly of the present invention can be used to cross connect pipes during the "on site" construction of a shade structure without the requirement for welding, and that no more than two people will be required to carry out the construction.

Still further advantages of the present invention will be apparent to persons skilled in the art.

It will also be readily apparent to persons skilled in the art that various modifications may be made in details of design and construction of the embodiments of the adjustable pipe coupling assembly, and in the steps of the process using the assembly described above without departing from the scope or ambit of the present invention.

For example, a small coupling pipe or adaptor of a predetermined length may be used to space apart the first and second clamps of the adjustable pipe coupling assembly to a required distance to suit the spacing apart of the cross connected pipes to a similarly required, but wider, distance. Having a number of such adaptors of different lengths available "on site" would be useful in circumstances where the distance that the cross connected pipes must be spaced apart varies in a structure under construction.

The reference in this specification to any prior publication (or information derived from it), or to any matter which is known, is not, and should not be taken as an acknowledgement or admission or any form of suggestion that that prior publication (or information derived from it) or known matter forms part of the common general knowledge in the technical field to which this specification relates before the priority date of this patent application.

The invention claimed is:

1. An adjustable pipe coupling assembly for a roof support arrangement of a shade structure, comprising:

(a) a first clamp, (b) a second clamp connected to the first clamp, (c) means for rotating the clamps independently and without restriction about a first common axis shared by the clamps and extending vertically, (d) a first round pipe having opposed first and second ends, (e) a second round pipe having opposed first and second ends, and being cross connected to the first round pipe by the interconnected first and second clamps, (f) the first clamp including a first pair of opposed ears between which is located a portion of the first pipe between the first and second ends such that the first and second ends extend remotely of the opposed ears, each one of the opposed ears having a hole formed therethrough, the pair of holes sharing a second common axis extending in a first horizontal plane, (g) a first pivot means received through the pair of holes and which engages transversely through the centre of the first pipe-to allow the first pipe to pivot in a first vertical plane about the second common axis, (h) the second clamp including a second pair of opposed ears between which is located a portion of the second pipe between the first and second ends such that the first and second ends extend remotely of the opposed ears, each one of the opposed ears having a hole formed therethrough, the pair of holes sharing a third common axis perpendicular to the second common axis and extending in a second horizontal plane, (i) a second pivot means received through the pair of holes and which engages transversely through the centre of the second pipe to allow the second pipe to pivot in a second vertical plane about the third common axis, the arrangement being such that, in use, rotating the clamps about the first common axis adjusts the horizontal angle between the second and third common axes, and pivoting the pipes about their respective pivot means adjusts the vertical angle between the pipes, thereby allowing for adjustment in the angle of cross connection of the pipes.

2. The adjustable pipe coupling assembly of claim 1, wherein the first and second clamps include respective planar surfaces that face each other, each planar surface having a hole formed therethrough, the holes being aligned to define the first common axis, and a pin passing through the holes to allow the clamps to rotate independently about the first common axis.

3. The adjustable pipe coupling assembly of claim 2, wherein the pin is a bolt.

4. The adjustable pipe coupling assembly of claim 3 wherein the first clamp includes a cradle for tightly receiving a head of the bolt.

5. The adjustable pipe coupling assembly of claim 4, wherein the cradle is formed from end surfaces of reinforced ribs.

6. The adjustable pipe coupling assembly of claim 1, wherein:

the clamps are round.

* * * * *